US006578309B1

(12) United States Patent
Frisce

(10) Patent No.: US 6,578,309 B1
(45) Date of Patent: Jun. 17, 2003

(54) REST FOR A WEAPON WITH A STOCK AND BARREL

(76) Inventor: Michael Martin Frisce, 807 Inspiration, San Antonio, TX (US) 78228

( * ) Notice: Subject to any disclaimer, the term of this patent is extended or adjusted under 35 U.S.C. 154(b) by 0 days.

(21) Appl. No.: 09/557,730

(22) Filed: Apr. 26, 2000

Related U.S. Application Data

(60) Provisional application No. 60/131,071, filed on Apr. 26, 1999, now abandoned.

(51) Int. Cl.[7] ..... F41A 9/62; F41A 29/00; F41A 31/00; F41A 27/00

(52) U.S. Cl. ..... 42/94; 89/37.04

(58) Field of Search ..... 42/94; 89/37.04

(56) References Cited

U.S. PATENT DOCUMENTS

| | | | | | |
|---|---|---|---|---|---|
| 758,015 | A | | 4/1904 | Miller | |
| 879,052 | A | | 2/1908 | Jeranek | |
| 989,386 | A | | 4/1911 | Miller | |
| 1,277,435 | A | | 9/1918 | Lesko | |
| 1,456,304 | A | | 5/1923 | Fritschka | |
| 1,666,293 | A | | 4/1928 | Lorton | |
| 2,690,211 | A | | 9/1954 | Wentz | |
| 2,740,530 | A | * | 4/1956 | Ponder | 211/64 |
| 3,022,898 | A | * | 2/1962 | Loeb | 211/64 |
| 3,156,062 | A | | 11/1964 | Stevenson | |
| 3,233,517 | A | * | 2/1966 | Morrison | 89/40 |
| 3,576,084 | A | | 4/1971 | Anderson | |
| 3,584,821 | A | | 6/1971 | Glebe | 248/156 |
| 4,007,554 | A | | 2/1977 | Helmstadter | |
| 4,481,964 | A | | 11/1984 | Minneman | 135/66 |
| 4,676,012 | A | | 6/1987 | Groba | 42/94 |
| 4,807,381 | A | * | 2/1989 | Southard | 42/94 |
| 4,854,066 | A | | 8/1989 | Canterbury | 42/94 |
| 4,882,869 | A | | 11/1989 | Webster | 42/94 |
| 4,893,427 | A | * | 1/1990 | Davidson | 42/94 |
| 4,937,965 | A | | 7/1990 | Narvaez | 42/94 |
| 5,375,905 | A | * | 12/1994 | Flitter et al. | 297/15 |
| 5,414,949 | A | * | 5/1995 | Peebles | 42/94 |
| 5,697,181 | A | * | 12/1997 | Savant | 42/94 |
| 5,715,625 | A | * | 2/1998 | West, III | 42/94 |
| 5,723,808 | A | * | 3/1998 | Devall | 89/37.04 |
| 5,778,589 | A | * | 7/1998 | Teague | 42/94 |
| 5,833,308 | A | * | 11/1998 | Strong, III et al. | 297/172 |
| 5,884,966 | A | * | 3/1999 | Hill et al. | 297/170 |
| 5,964,435 | A | * | 10/1999 | Peltier | 248/166 |
| 5,974,719 | A | * | 11/1999 | Simonek | 42/94 |
| 5,979,099 | A | * | 11/1999 | Kervin | 42/94 |
| 6,044,747 | A | * | 4/2000 | Felts | 89/40.06 |
| 6,269,578 | B1 | * | 8/2001 | Callegari | 42/94 |
| 6,283,428 | B1 | * | 9/2001 | Maples et al. | 248/282.1 |

* cited by examiner

*Primary Examiner*—Peter M. Poon
*Assistant Examiner*—Bethany L Griles
(74) *Attorney, Agent, or Firm*—Jackson Walker L.L.P.

(57) ABSTRACT

Applicant provides a device on which the barrel of weapon may rest to assist in aiming the weapon, a weapon for example, such a rifle. The device includes a horizontal barrel engagement member that has a straight portion and, typically, two angle portions. A wall engagement bracket descends from the horizontal barrel engagement member, the bracket for engagement with a support surface, such as a wall of a hunting blind. The wall bracket may be height adjustable with respect to the horizontal barrel engagement member.

6 Claims, 5 Drawing Sheets

REST FOR A WEAPON WITH A STOCK AND BARREL

This application claims priority from provisional patent application No. 60/131,071 now abandoned.

BACKGROUND OF THE INVENTION

1. Field of the Invention

Applicant's invention relates to a device to rest the barrel of a weapon thereon; more particularly, a device to rest the barrel of a weapon thereon which device includes means engageable with a vertical support surface such as a wall.

2. Background Information

Weapons, including gun rests, are old art. They come in many designs having many different features and a good summary of the prior art may be found in U.S. Pat. No. 5,740,625, to Jenkins, the specifications of which are incorporated herein by reference.

Hunting is a sport with enduring widespread popularity. Hunting blinds are used to provide shelter and camouflage to hunters. Hunting blinds typically include an opening in the wall thereof from which to site the prey and from which to support a weapon, such as a rifle. What has heretofore been unavailable is a rest, easily attachable to a vertical support surface, such as the side wall of a hunting blind, which allows the hunter to rest the barrel of his weapon thereon while aiming.

Applicant provides for such a device in a gun barrel rest. Applicant's gun barrel rest is designed to provide quick engagement to a vertical support wall, such as the side wall of a hunting blind. Applicant's gun rest is also designed to provide secure engagement with the barrel of a weapon.

Applicant's gun rest is designed to provide further advantages, including the advantage of aiming the weapon at various angles with respect to the gun rest.

Yet additional features of Applicant's gun rest include a quick release bracket capable of engaging a gun barrel support member to a vertical support wall in a manner that will allow the bracket to stay permanently affixed to the wall, but also allow the barrel engagement member to be removed therefrom.

Additional features of Applicant's gun rest include means for vertically adjusting the position of the barrel engagement member of the gun rest with respect to a vertical support member to which the barrel engagement member is attached.

Additional features of Applicant's gun rest include walls of a barrel engagement member dimensioned for maintaining the barrel of the weapon at different heights with respect to the vertical wall support member.

Additional features of Applicant's present invention include a support arm for maintaining a barrel engagement member of the gun rest in horizontally spaced-apart relation with respect to the vertical support wall to which the gun rest is engaged.

Other features will be apparent with respect to the specifications and drawings.

DETAILED DESCRIPTION OF THE PREFERRED EMBODIMENT

Figure 1:
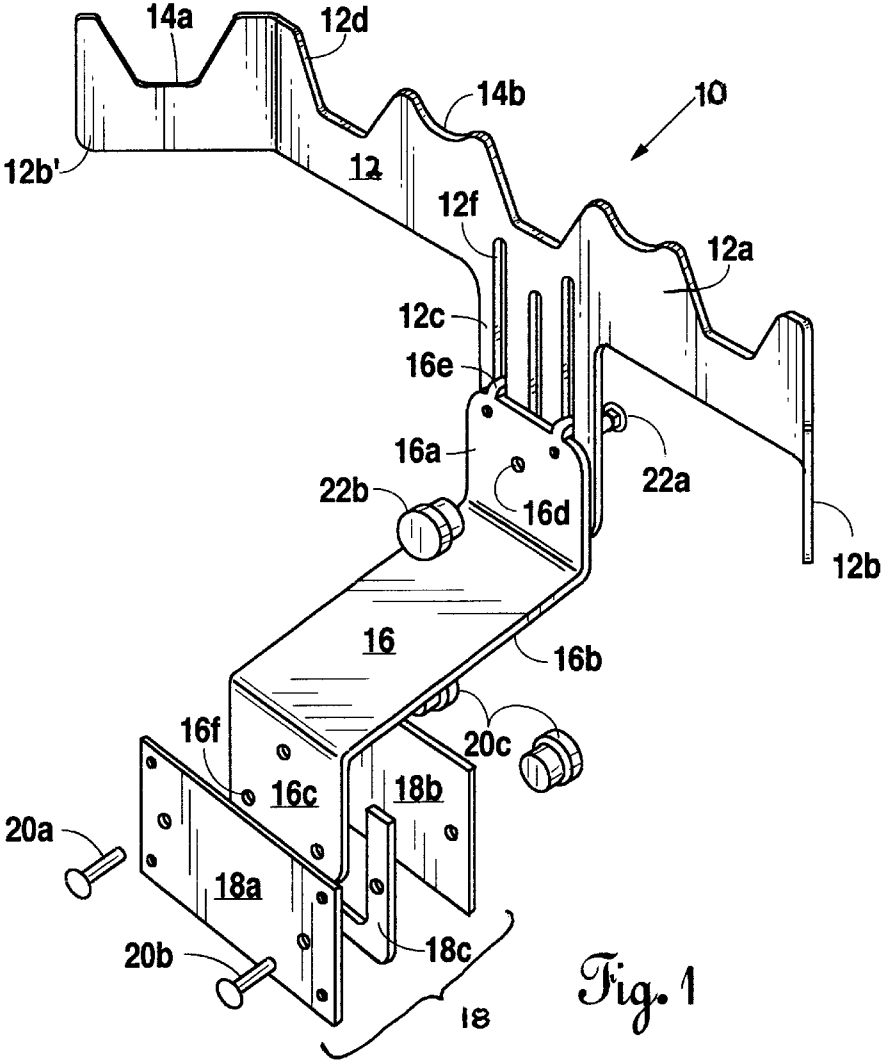
FIG. 1 is a perspective view of Applicant's gun rest.

FIG. 1 is a perspective view of Applicant's gun rest 10. As can be appreciated with reference to FIG. 1, Applicant's gun rest 10 includes a T-shaped, rigid, barrel engagement member 12, a support arm 16, and a multi-element wall engagement bracket 18.

Barrel engagement member 12 is typically designed of sheet aluminum, 1–90 gauge, and has a straight portion 12A and, at the ends of each of straight portion 12A are located angled portions 12B and 12B'. The angled portions make an acute angle with the longitudinal axis of the straight portion and provide the hunter with the ability of placing the gun at an angle with respect to straight portions.

Depending vertically downward from the central part of the body of straight portion 12A is leg 12C, the leg having walls defining three slots 12F therein. There are typically three slots and, as set forth in further detail below, the slots allow one to raise and lower the barrel engagement member vertically with respect to the wall engagement bracket 18 and support arm 16 while maintaining horizontal alignment of the barrel engagement member 12.

Thus, it is seen that barrel engagement member 12 is generally T-shaped with the straight portion and the two angled portions 12B and 12B' representing the arms of the "T" with the leg 12C depending downward therefrom. Moreover, it can be seen that if the barrel engagement member is rigidly placed, such as to a vertical support surface, the barrel of the weapon may be engaged with upper walls 12D of the barrel engagement member. More specifically, upper walls 12D are seen to be dimensioned so as to define a series of cradle shaped cut-outs 14A (deep) and 14B (shallow). It can be seen that the cut-outs have different shapes. Cut-outs 14A are deep and 14B are shallow, thus allowing the stock and/or barrel of the weapon to sit lower. Moreover, cut-outs 14A have more side wall support than cutouts 14B to help prevent lateral displacement of the weapon from side-to-side, thereby providing more stability. However, cradle cut-outs 14A and 14B serve the same primary function of providing a horizontal support surface to the barrel of the weapon, where cut-out 14A provides lateral (side) support to more securely locate the barrel of the weapon.

Figure 1A:
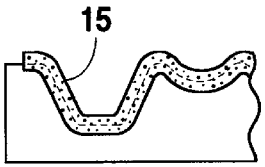
FIG. 1A is a cut away of a portion of Applicant's gun rest, in front elevational view.

Further, with respect to FIG. 1A it may be seen that upper walls 12D may be provided with cushions 15, such as rubber, plastic or other flexible tubing or member to provide a soft surface on which to lay the weapon, to help prevent slippage and also to help prevent the surface of the weapon from marred by a hard metallic edge.

Support arm 16, appropriately angled and dimensioned and typically made of 1–90 gauge aluminum or other suitable material, is provided to engage wall engagement bracket 18 in a manner to rigidly locate the barrel engagement member 12 at a distance horizontally spaced-apart from and typically elevated above a vertical support wall, to which wall engagement bracket 18 is affixed. By displacing the barrel engagement member apart from the side wall of, say, a hunting blind, the hunter may stand or kneel close to the inner surface of the wall, while maintaining a weapon, such as a rifle, against his shoulder, but, at the same time, providing an appropriate balance point for the barrel of the weapon, the balance point being at engagement with the barrel engagement member when it is spaced outward from the vertical wall. In other words, support arm 16 generally locates the barrel engagement member by providing some horizontal displacement between the wall engagement bracket 18 and the barrel engagement member 12. This generally proves to be more useful than mounting a barrel engagement directly above, say, the top edge of a blind side wall. However, for further options, as is set forth in more detail below, Applicant's barrel engagement member portion of gun rest 10 may be separated from support arm 16 and engaged directly to wall engagement bracket 18 (rather than attached to the wall engagement bracket through the use of support arm 16) so as to indeed stay directly vertically above the surface from which wall engagement bracket 18 is mounted. Simply put, Applicant's invention provides the hunter the option of either position.

Turning now to the details of support arm 16, it is seen that support arm 16 includes a vertical portion 16A designed to engage the leg of the barrel engagement member as set forth in more detail below. Support arm 16 also includes a transverse member 16B which is generally perpendicular to the vertical portion (see FIG. 1). Finally, at a second end opposite the vertical portion 16A is a bracket engagement portion 16C. All three portions are integral, but vertical portion 16A ascends upward from transverse member 16B and bracket engagement member 16C depends downward, again, being generally perpendicular to transverse member 16B.

Vertical portion 16A and bracket engagement portion 16C have holes therein whose purpose is set forth in more detail below. Further, it is seen that support arm 16 includes guides 16E, typically a pair, on the upper perimeter of vertical portion 16A and projecting outward and lateral thereto. Guides 16E are designed to engage the two outer slots of slots 12F of leg 12C of the barrel engagement member. The single hole 16D in the vertical portion 16A is designed to be located along the track of the central of the three slots 12F of leg 12C of the barrel engagement member 12. Thus, it can be seen that the combination of the guides insertable into the two outer slots, and a bolt 22A with a threaded aluminum knob 22B engageable to the removed end thereof, may be used to adjust the vertical position of the barrel engagement member 12 by insertion through a center of the three slots and hole 16D in the vertical portion 16A, the bolt secured with threaded knob 22B to maintain the barrel engagement member 12 in a vertical position above support arm 16 in such a fashion that the support arm will not twist, as interference between the guides and the slot would prevent this. This arrangement allows a single, simple, threaded knob 22B to release compression and allow the barrel engagement member 12 to move up and down, or to be tightened and rigidly maintained to hold barrel engagement member 12 at a preset distance above the support arm.

Turning now to engagement bracket 18, it is seen that engagement bracket 18 includes three elements; an inner plate 18A, a outer plate 18B, and a quick release plate 18C. The quick release plate 18C mounts between outer plate 18B and inner plate 18A. Moreover, it may be seen with reference to FIGS. 1 and 7 that quick release plate 18C is dimensioned to be U-shaped with the profile matching that of both bracket engagement member 16C and the profile of leg 12C. Fasteners 20A, 20B, and 20C are designed to fasten the inner plate 18A against quick release plate 18C and outer plate 18B. The inner plate 18A is mounted to the sidewall of, for example, a hunting blind. If the thickness of the quick release plate is approximately equal to or slightly less than that of bracket engagement 16C at support arm 16 and leg 12C of bracket engagement member 12, then either of those elements will slide in snugly to rest against the inner wall of quick release plate 18C when fastener knobs 20A and 20C are loose. When knobs are tightened down, the bracket engagement member 16C will be pressed tightly between inner plate 18A and the wall with quick release plate 18C preventing twisting of support arm. On the other hand, if the hunter wants to mount bracket engagement member 12 directly to the wall without the use of a support arm 16, then leg 12C is inserted into the space created by quick release plate 18C while the knobs 20C are loose, and when leg 12C is seated in quick release plate 18C between the inner surface of the wall and inner plate 18A with the knobs tightened down, the bracket engagement member will be held rigidly vertically without any twisting.

It is also seen with reference to FIG. 1 that there are three holes 16F in bracket engagement member 16C. The use of these holes allows one to directly mount the support arm 16 to a side wall of blind through the use of appropriate fasteners, and obviates the need for wall engagement bracket 18. It is a more permanent attachment and does not provide for the ready change out of the support arm with the leg of the barrel engagement member. Nonetheless, where permanent attachment is desired, the use of the holes on the bracket engagement member with appropriate fasteners allows for such an option.

An appropriate material from which to manufacture components of the device are as follows: barrel engagement member 12, 1–90 Alum.; support arm, 1–90 Alum.; and wall engagement bracket, 1–90 Alum. Moreover, the elements may be powder coated in a dull or non-gloss dark or black finish to prevent reflection therefrom.

Figure 1B:
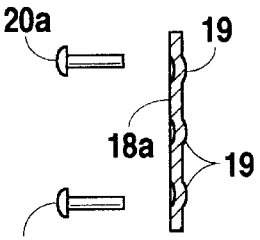
FIG. 1B is side elevation of view of detail of Applicant's gun rest.
Figure 1C:
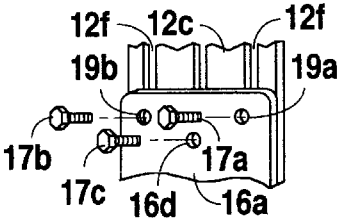
FIG. 1C is a detailed perspective view of the manner in which the barrel engagement member (12) adjustment engages support arm (16).

FIG. 1B illustrate use of dimples 19 to help prevent bracket engagement member 16 from a loose engagement with wall engagement bracket 18. FIG. 1C shows an alternate means of attaching leg 12C to bracket engagement member 16 thru the use of two threaded holes 19A in vertical portion 16A aligned with the two outer slots of slots 12F. Guides 16E are not needed as bolts 17A and 17B are threaded into the holes 19A and 19B so that the removed ends of bolts 17A and 17B ride in the outer slots. Also illustrated in FIG. 1C is the use of a threaded fastener 17C engageable with a threaded hole 17D in the vertical portion. A nut will engage the removed end of bolt 17C to hold the barrel engagement member at the desired height.

Figure 2C:
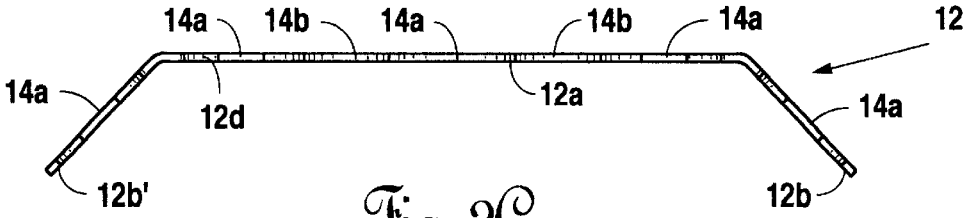
FIG. 2C illustrates a top elevational view of the barrel engagement member of Applicant's gun rest.
Figure 2B:
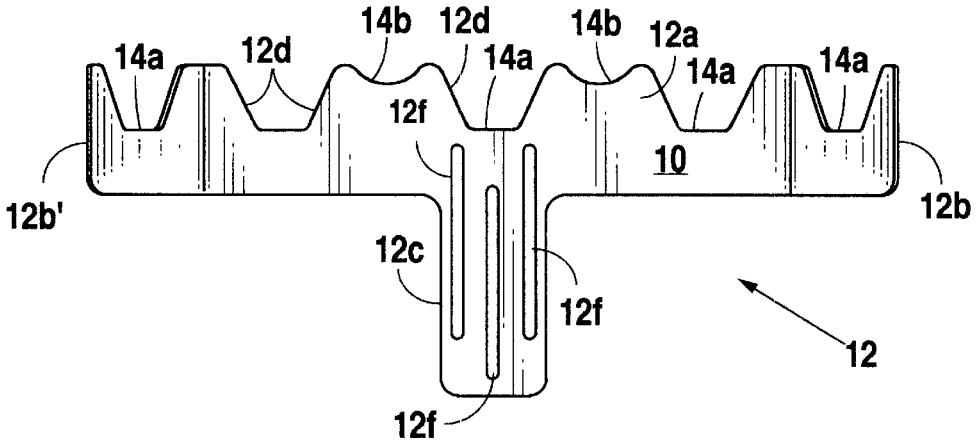
FIG. 2B illustrates the front elevational view of the barrel engagement member of Applicant's gun rest.
Figure 2A:
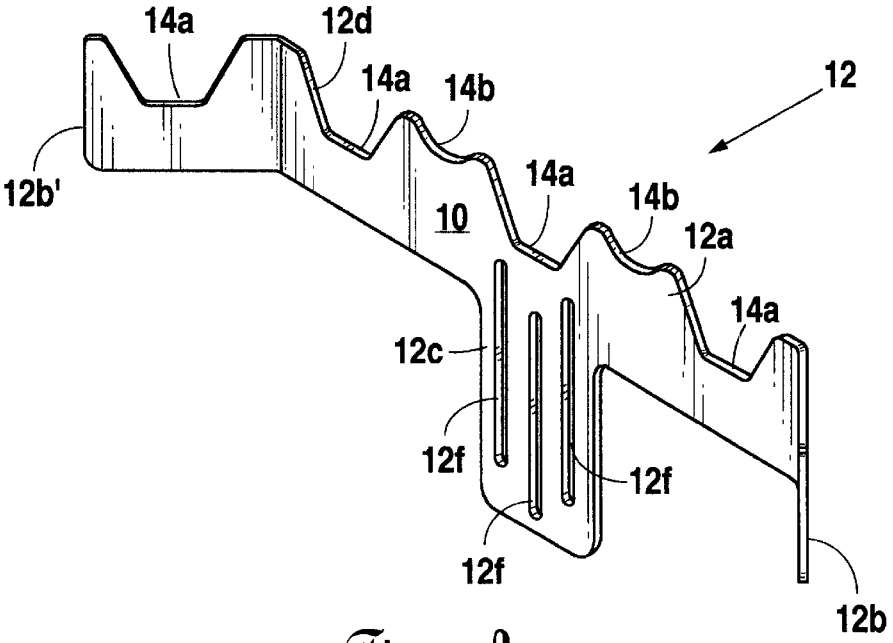
FIG. 2A illustrates, in perspective view, details of the barrel engagement member of Applicant's gun rest.

FIGS. 2A, 2B, and 2C illustrate additional views and dimensions of the barrel engagement member of Applicant's present invention. The dimensions are recommended only, and other dimensions may be as deemed appropriate, staying within the spirit of Applicant's present invention.

Figure 3A:
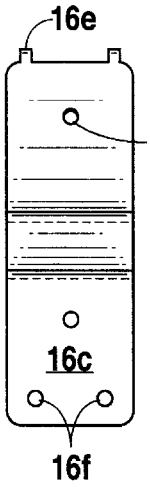
FIGS. 3A, 3B and 3C illustrate top elevation, side elevation, and perspective views of the support arm of Applicant's gun rest.
Figure 3B:
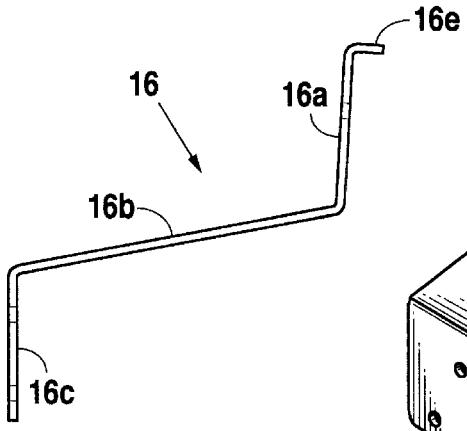
Figure 3C:
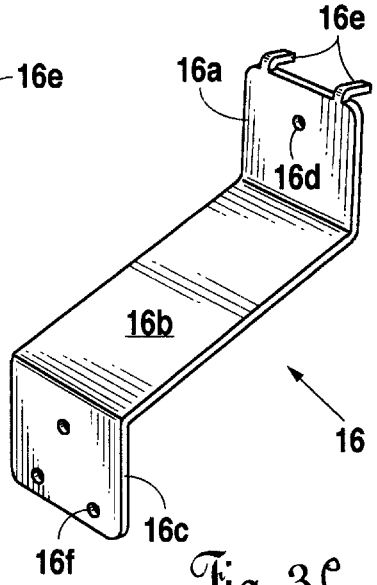

FIGS. 3A, 3B, and 3C illustrate additional views of the support arm of Applicant's present invention. It can further be seen with reference to FIG. 2B that the angles between the transverse section and the two vertical ends of the support arm may be slightly more than 100 degrees to provide for some vertical displacement of the barrel engagement member.

Figure 4:
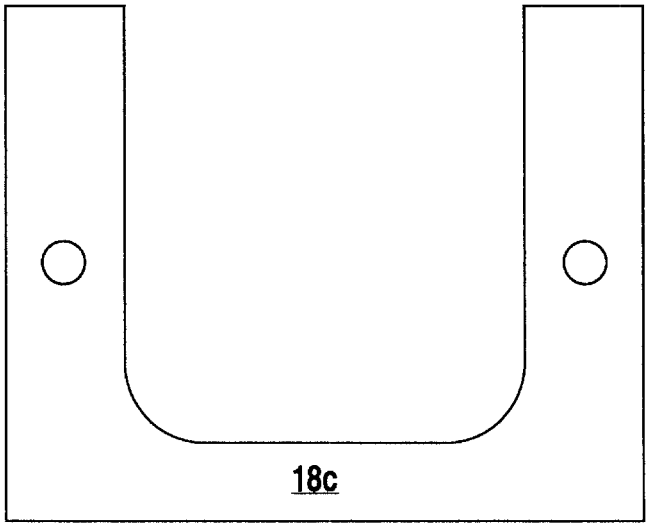
FIG. 4 illustrates in front elevational view the quick release plate of Applicant's gun rest.
Figure 5:
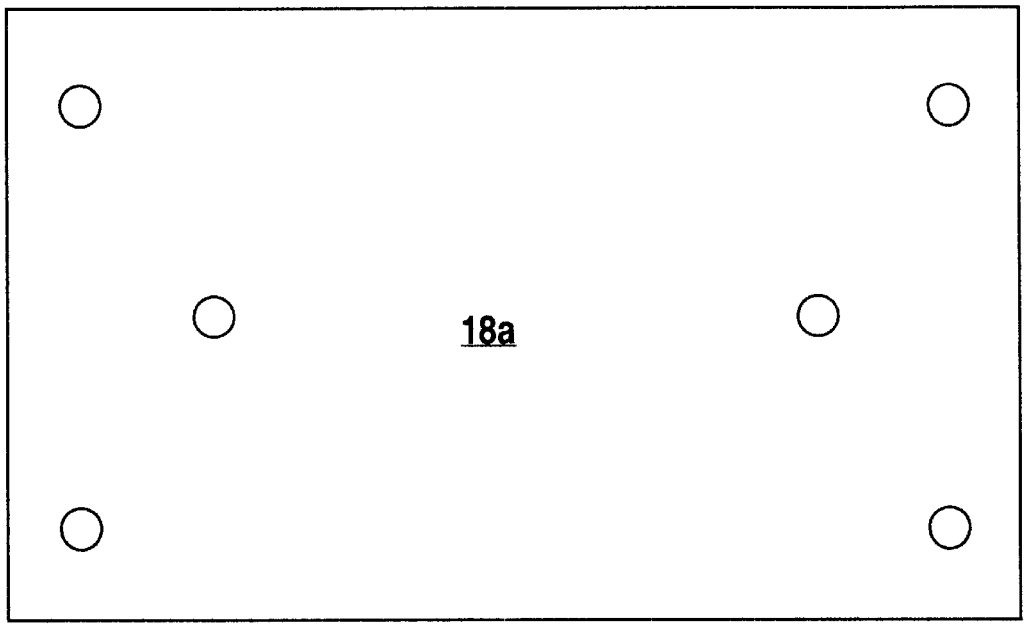
FIG. 5 illustrates a top elevational view of the inner plate of Applicant's gun rest.
Figure 6:
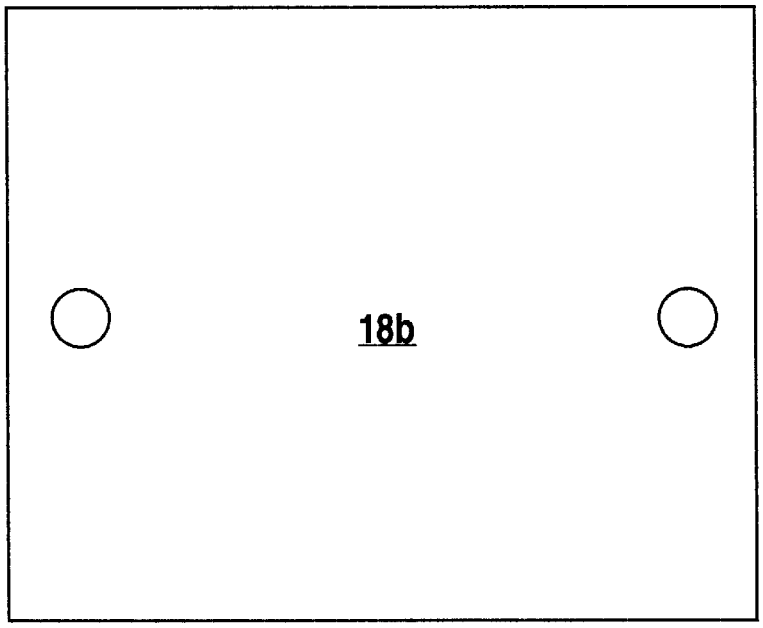
FIG. 6 illustrates a top elevational view of the outer plate of Applicant's gun rest.

FIG. 4 is an additional view of quick release plate 18C showing again possible dimensions. Likewise, FIG. 4 and FIG. 5 provide additional details and dimensions of Applicant's inner plate and outer plate, respectively.

Figure 7:
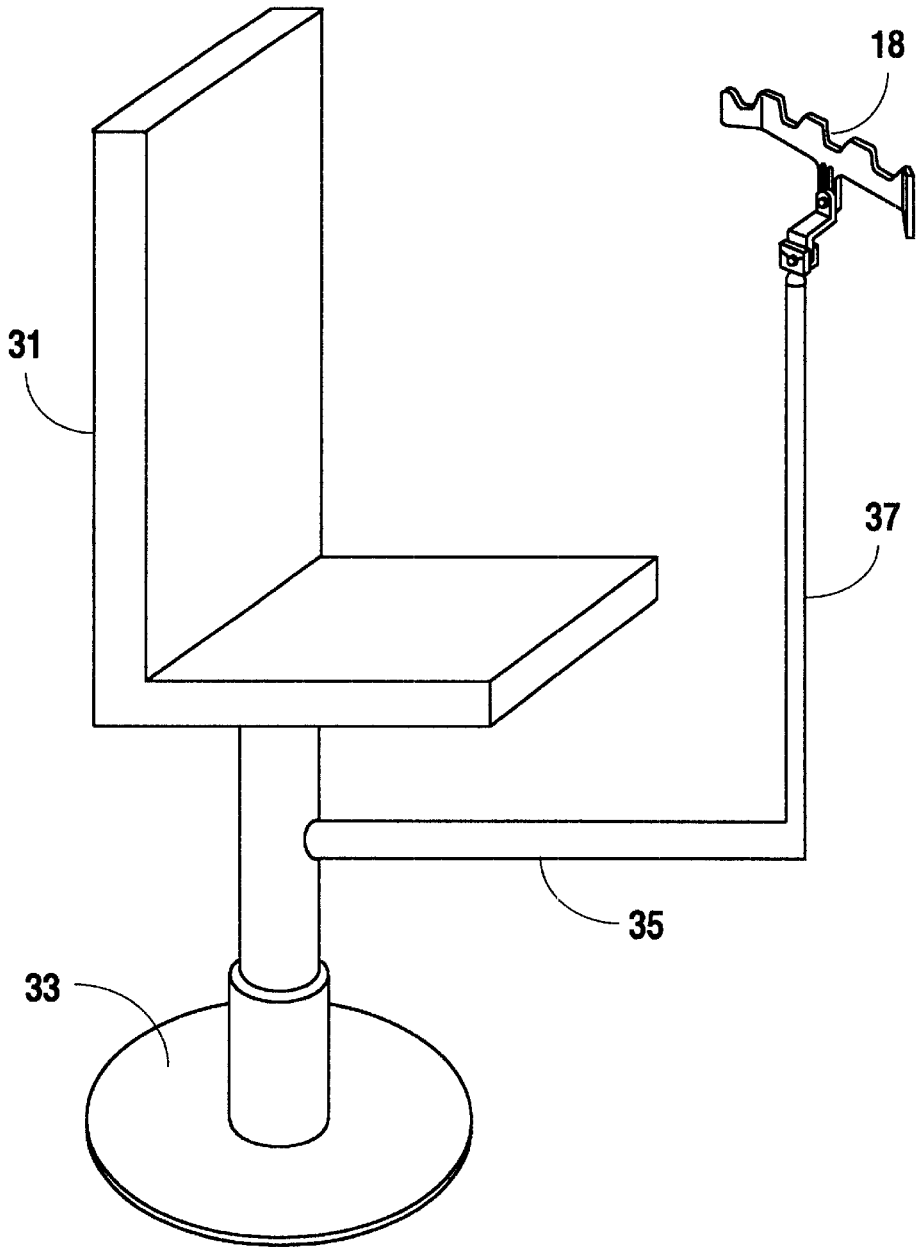
FIG. 7 is perspective view of Applicant's wall engagement member attached to a seat which is mounted to a rotatable base.

FIG. 7 provides a seat 31 rotatably mounted to a base 33 onto which a horizontal member 35 and vertical member 37 provide support to Applicant's wall engagement bracket 18, to which the barrel engagement member may be attached directly or through the use of the support arm 16.

Thus, it can be seen that Applicant provides for a number of advantageous features novel over the prior art gun support, among such novel features being the interchangeability of a barrel engagement member with either a wall mounted bracket or a support arm for displacement from the vertical wall, multi-cradle barrel engagement walls, as well as straight or angled options, etc.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A device capable of engagement with a vertical support surface for resting a weapon upon, the weapon having a barrel, the device comprising:

a barrel engagement member including a straight portion and at least one angled portion, the straight portion and the angled portion integral to one another, the barrel engagement member having upper walls, the upper walls defining a multiplicity of cut-outs, the cut-outs dimensioned for receipt of the barrel of the weapon thereupon, the barrel engagement member including a vertical leg depending therefrom, the vertical leg having a multiplicity of slots therein;

a wall engagement bracket for engagement with a vertical support surface;

a support arm having a first end a second end, the first end including means to engage the slots of the vertical leg of the barrel engagement member to allow the barrel engagement member to be adjusted to a selected height and the second end including means to engage the wall engagement bracket; and fasteners for cooperatively engaging the wall engagement member to the support arm and vertical support surface, the fasteners also for engaging the support arm to the barrel engagement member to rigidly locate the device against the vertical support wall so as to allow the barrel of the weapon to rest thereupon.

2. The device of claim 1 wherein the vertical leg of the barrel engagement member and the wall engagement bracket are adapted to cooperatively engage so that the barrel engagement member may be attached directly to the wall engagement bracket.

3. The device of claim 1 wherein the multiplicity of cutouts include cutouts defining a first depth and cutouts defining a second depth, the first depth greater than the second depth.

4. The device of claim 1 wherein the at least one angled portion of the barrel engagement member includes two angled portions located at the removed ends of the straight portion at an acute angle thereto.

5. The device of claim 1 wherein the cutouts include cushion members engaged therewith.

6. The device of claim 1 wherein the support arm includes a transverse portion between the two ends to space the barrel engagement member horizontally away from the wall engagement bracket.

* * * * *